US007967583B2

(12) United States Patent
Stover et al.

(10) Patent No.: US 7,967,583 B2
(45) Date of Patent: Jun. 28, 2011

(54) COMPRESSOR HAVING CAPACITY MODULATION SYSTEM

(75) Inventors: Robert C. Stover, Versailles, OH (US); Masao Akei, Miamisburg, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 204 days.

(21) Appl. No.: 12/474,954

(22) Filed: May 29, 2009

(65) Prior Publication Data

US 2009/0297380 A1 Dec. 3, 2009

Related U.S. Application Data

(60) Provisional application No. 61/057,401, filed on May 30, 2008.

(51) Int. Cl.
*F04C 18/02* (2006.01)
*F04C 29/00* (2006.01)

(52) U.S. Cl. ..... 418/55.2; 418/55.1; 417/310; 417/307; 417/440

(58) Field of Classification Search ..... 418/22, 418/55.1, 55.2, 55.5; 417/310, 308, 307, 417/440
See application file for complete search history.

(56) References Cited

U.S. PATENT DOCUMENTS

| | | | |
|---|---|---|---|
| 4,382,370 | A | 5/1983 | Suefuji et al. |
| 4,383,805 | A | 5/1983 | Teegarden et al. |
| 4,497,615 | A | 2/1985 | Griffith |
| 4,774,816 | A | 10/1988 | Uchikawa et al. |
| 4,818,195 | A | 4/1989 | Murayama et al. |
| 4,940,395 | A | 7/1990 | Yamamoto et al. |
| 5,074,760 | A | 12/1991 | Hirooka et al. |
| RE34,148 | E | 12/1992 | Terauchi et al. |
| 5,169,294 | A | 12/1992 | Barito |
| 5,192,195 | A | 3/1993 | Iio et al. |
| 5,193,987 | A | 3/1993 | Iio et al. |
| 5,240,389 | A | 8/1993 | Oikawa et al. |

(Continued)

FOREIGN PATENT DOCUMENTS

JP 03081588 A 4/1991

(Continued)

OTHER PUBLICATIONS

International Search Report dated Jan. 8, 2010 regarding International Application No. PCT/US2009/045665.

(Continued)

*Primary Examiner* — Thomas E Denion
*Assistant Examiner* — Mary A Davis
(74) *Attorney, Agent, or Firm* — Harness, Dickey & Pierce, P.L.C.

(57) ABSTRACT

A compressor includes orbiting and non-orbiting scroll members meshingly engaged to form a series of compression pockets, including first pockets when the orbiting scroll member is in a first position. A first porting in the non-orbiting scroll member communicates with the first pockets during a portion of a compression cycle. The first pockets include a set of radially outermost pockets located radially inward relative to the first porting and isolated from communication with the first porting during the compression cycle. The first porting is aligned with a spiral wrap of the orbiting scroll member at a location radially outward from and directly adjacent the first pockets when the orbiting scroll member is in the first position. Additional porting communicates with each of the compression pockets located radially outward relative to the first pockets when the orbiting scroll member is in the first position.

17 Claims, 11 Drawing Sheets

U.S. PATENT DOCUMENTS

| | | | |
|---|---|---|---|
| 5,356,271 | A | 10/1994 | Miura et al. |
| 5,451,146 | A | 9/1995 | Inagaki et al. |
| 5,551,846 | A | 9/1996 | Taylor et al. |
| 5,557,897 | A | 9/1996 | Kranz et al. |
| 5,562,426 | A | 10/1996 | Watanabe et al. |
| 5,577,897 | A | 11/1996 | Inagaki et al. |
| 5,639,225 | A | 6/1997 | Matsuda et al. |
| 5,674,058 | A | 10/1997 | Matsuda et al. |
| 5,678,985 | A | 10/1997 | Brooke et al. |
| 5,855,475 | A | 1/1999 | Fujio et al. |
| 5,885,063 | A | 3/1999 | Makino et al. |
| 5,993,171 | A | 11/1999 | Higashiyama |
| 5,993,177 | A | 11/1999 | Terauchi et al. |
| 6,102,671 | A | 8/2000 | Yamamoto et al. |
| 6,123,517 | A | 9/2000 | Brooke et al. |
| 6,132,179 | A | 10/2000 | Higashiyama |
| 6,164,940 | A | 12/2000 | Terauchi et al. |
| 6,210,120 | B1 | 4/2001 | Hugenroth et al. |
| 6,213,731 | B1 | 4/2001 | Doepker et al. |
| 6,231,316 | B1 | 5/2001 | Wakisaka et al. |
| 6,273,691 | B1 | 8/2001 | Morimoto et al. |
| 6,412,293 | B1 | 7/2002 | Pham et al. |
| 6,413,058 | B1 | 7/2002 | Williams et al. |
| 6,589,035 | B1 | 7/2003 | Tsubono et al. |
| 6,769,888 | B2 | 8/2004 | Tsubono et al. |
| 6,884,042 | B2 | 4/2005 | Zili et al. |
| 6,984,114 | B2 | 1/2006 | Zili et al. |
| 7,118,358 | B2 | 10/2006 | Tsubono et al. |
| 7,137,796 | B2 | 11/2006 | Tsubono et al. |
| 7,229,261 | B2 | 6/2007 | Morimoto et al. |
| 7,344,365 | B2 | 3/2008 | Takeuchi et al. |
| 7,354,259 | B2 | 4/2008 | Tsubono et al. |
| 2004/0146419 | A1 | 7/2004 | Kawaguchi et al. |
| 2004/0197204 | A1 | 10/2004 | Yamanouchi et al. |
| 2005/0019177 | A1 | 1/2005 | Shin et al. |
| 2005/0053507 | A1 | 3/2005 | Takeuchi et al. |
| 2008/0159892 | A1 | 7/2008 | Huang et al. |
| 2009/0071183 | A1* | 3/2009 | Stover et al. ..... 418/55.1 |
| 2009/0297377 | A1* | 12/2009 | Stover et al. ..... 418/55.1 |
| 2009/0297378 | A1* | 12/2009 | Stover et al. ..... 418/55.1 |
| 2009/0297379 | A1* | 12/2009 | Stover et al. ..... 418/55.1 |
| 2010/0135836 | A1* | 6/2010 | Stover et al. ..... 418/55.2 |
| 2010/0158731 | A1* | 6/2010 | Akei et al. ..... 418/55.2 |
| 2010/0300659 | A1* | 12/2010 | Stover et al. ..... 418/55.1 |
| 2010/0303659 | A1* | 12/2010 | Stover et al. ..... 418/55.1 |

FOREIGN PATENT DOCUMENTS

| | | | |
|---|---|---|---|
| JP | 2000161263 | A | 6/2000 |
| JP | 2007154761 | A | 6/2007 |

OTHER PUBLICATIONS

Written Opinion of the International Search Authority dated Jan. 8, 2010 regarding International Application No. PCT/US2009/045665.

* cited by examiner

COMPRESSOR HAVING CAPACITY MODULATION SYSTEM

CROSS-REFERENCE TO RELATED APPLICATIONS

This application claims the benefit of U.S. Provisional Application No. 61/057,401, filed on May 30, 2008. The entire disclosure of the above application is incorporated herein by reference.

FIELD

The present disclosure relates to compressors, and more specifically to compressors having capacity modulation systems.

BACKGROUND

This section provides background information related to the present disclosure and is not necessarily prior art.

Scroll compressors include a variety of capacity modulation mechanisms to vary operating capacity of a compressor. The capacity modulation mechanisms may include fluid passages extending through a scroll member to selectively provide fluid communication between compression pockets and another pressure region of the compression.

SUMMARY

This section provides a general summary of the disclosure, and is not a comprehensive disclosure of its full scope or all of its features.

A compressor may include a housing and a non-orbiting scroll member supported within the housing and including a first end plate and a first spiral wrap extending from the first end plate. The orbiting scroll member may be supported within the housing and include a second end plate having a second spiral wrap extending therefrom and meshingly engaged with the first spiral wrap to form a series of compression pockets. A first porting may extend through the first end plate and is located radially outward relative to a radially outer surface of the first spiral wrap at least five hundred and forty degrees inward along the first spiral wrap from an outer end thereof. The first porting may be in communication with a first pocket of the series of compression pockets during a portion of a compression cycle of the orbiting and non-orbiting scroll members. The first and second spiral wraps may abut one another to define first modulated capacity pockets when the orbiting scroll member is in a first position. The first modulated capacity pockets may include a set of radially outermost compression pockets located radially inward relative to the first porting and isolated from communication with the first porting during an entirety of the compression cycle. The first porting may align with the second spiral wrap at a location radially outward from and directly adjacent the first modulated capacity pockets when the orbiting scroll member is in the first position. The additional porting may extend through the first end plate and in communication with each of the compression pockets located radially outward relative to the first modulated capacity pockets when the orbiting scroll member is in the first position.

The compressor porting may have an angular extent of at least twenty degrees.

The compressor may include a first angular position, which is defined by the abutting of the first and second spiral wrap, defining a starting location of the first porting.

The compressor may include a second porting extending through the first end plate and located radially inward relative to a radially inner surface of the first spiral wrap at least three hundred and sixty degrees inward along the first spiral from the outer end thereof. The second porting may be in communication with a second of the compression pockets during a portion of the compression cycle. The first and second spiral wraps may abut one another to define second modulated capacity pockets when the orbiting scroll member is in a second position subsequent to the first position. The second modulated capacity pockets including a set of radially outermost compression pockets located radially inward relative to the first and second porting and isolated from communication with the first and second porting during an entirety of the compression cycle.

The compressor second porting may have an angular extent of at least twenty degrees.

The compressor second porting may align with the second spiral wrap at a location radially outward from and directly adjacent the second set of radially outermost pockets when the orbiting scroll member is in the second position.

The compressor second porting may be in communication with the first modulated capacity pockets when the orbiting scroll member is in the first position.

The compressor second modulated capacity pockets may correspond to the first modulated capacity pockets after displacement of the orbiting scroll member from the first position to the second position.

The compressor's additional porting may include a third porting located radially outward relative to the radially outer surface of the first spiral wrap less than five hundred and forty degrees inward along the first spiral from the outer end thereof.

The compressor's additional porting may include a fourth porting located radially inward relative to the radially inner surface of the first spiral wrap less than three hundred and sixty degrees inward along the first spiral from the outer end thereof.

The compressor pressure in the first porting may continuously increasing during the compression cycle.

The compressor may include a second spiral wrap overlies an entirety of the first porting when the orbiting scroll member is in the first position.

The compressor first porting may be isolated from communication with the compression pockets by the second spiral wrap when the orbiting scroll member is in the first position.

The compressor first porting may include a continuous aperture.

The compressor porting may include a series of discrete apertures.

The compressor may comprise a valve member in communication with the first porting and the additional porting to selectively provide communication between the compression pockets located radially outward from the first modulated capacity pockets and a bypass location external to the compression pockets.

The compressor bypass location may include a suction pressure region of the compressor.

Further areas of applicability will become apparent from the description provided herein. The description and specific examples in this summary are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
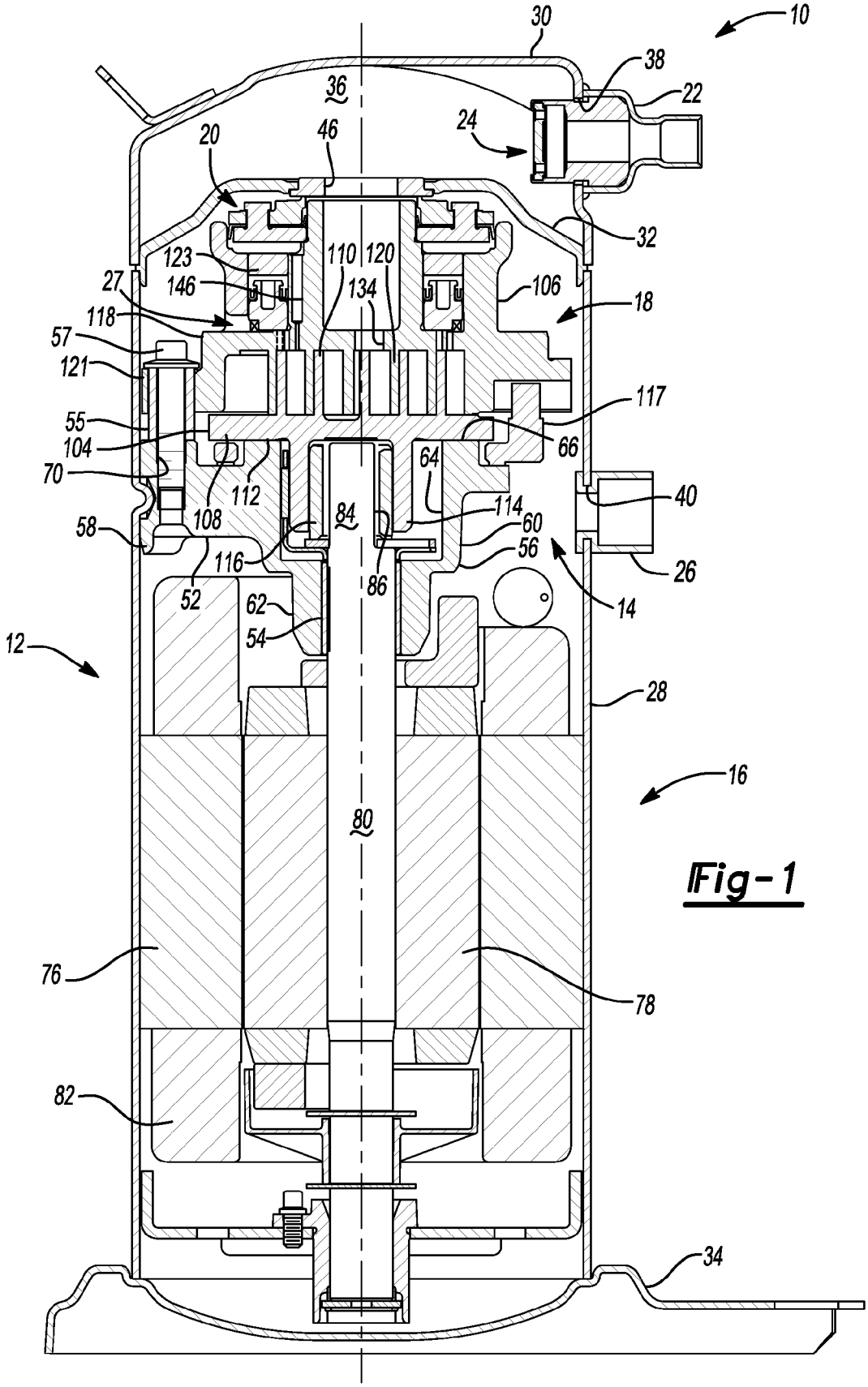
FIG. 1 is a section view of a compressor according to the present disclosure.
Figure 2:
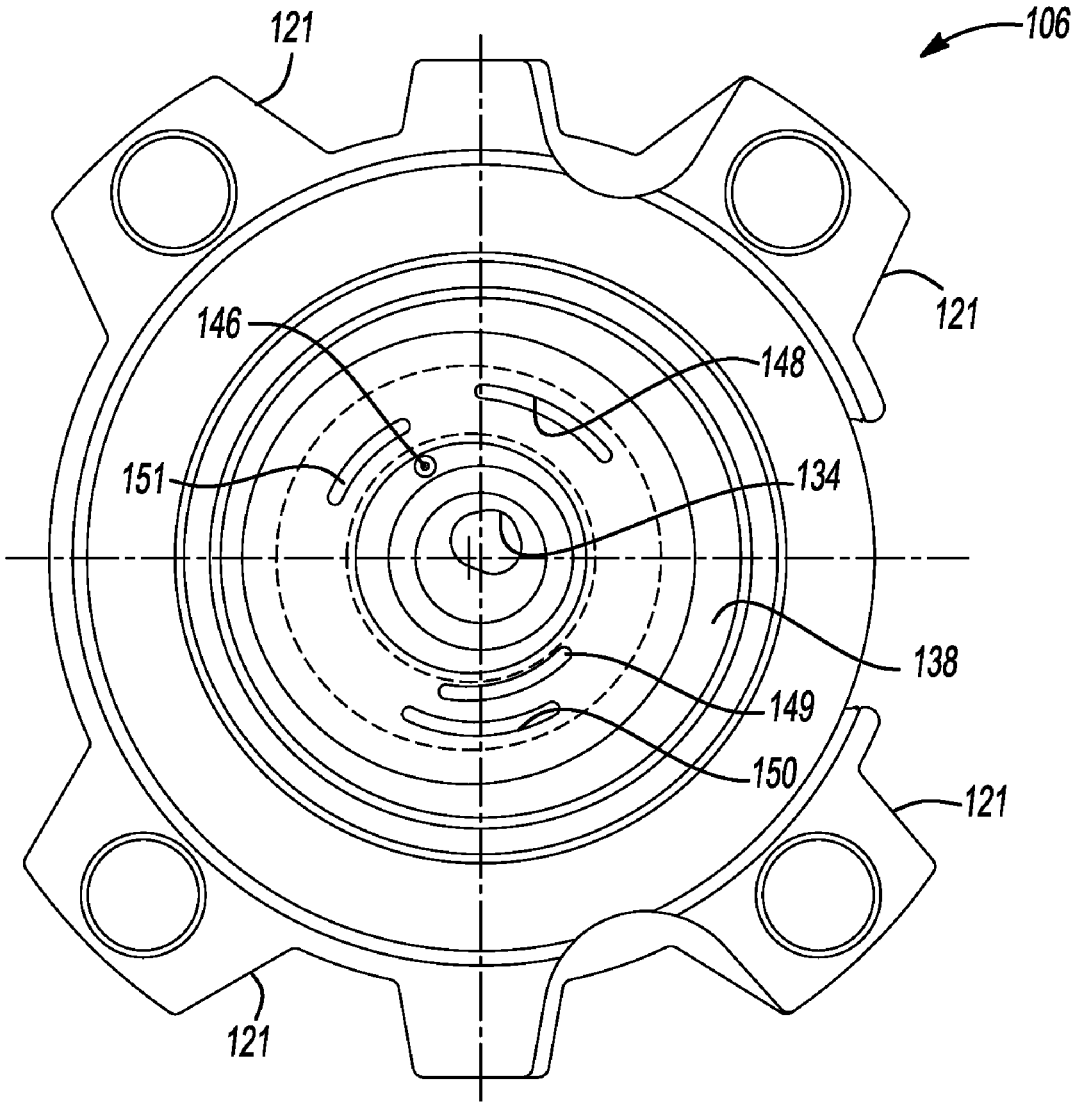
FIG. 2 is a plan view of a non-orbiting scroll member of the compressor of FIG. 1.
Figure 3:
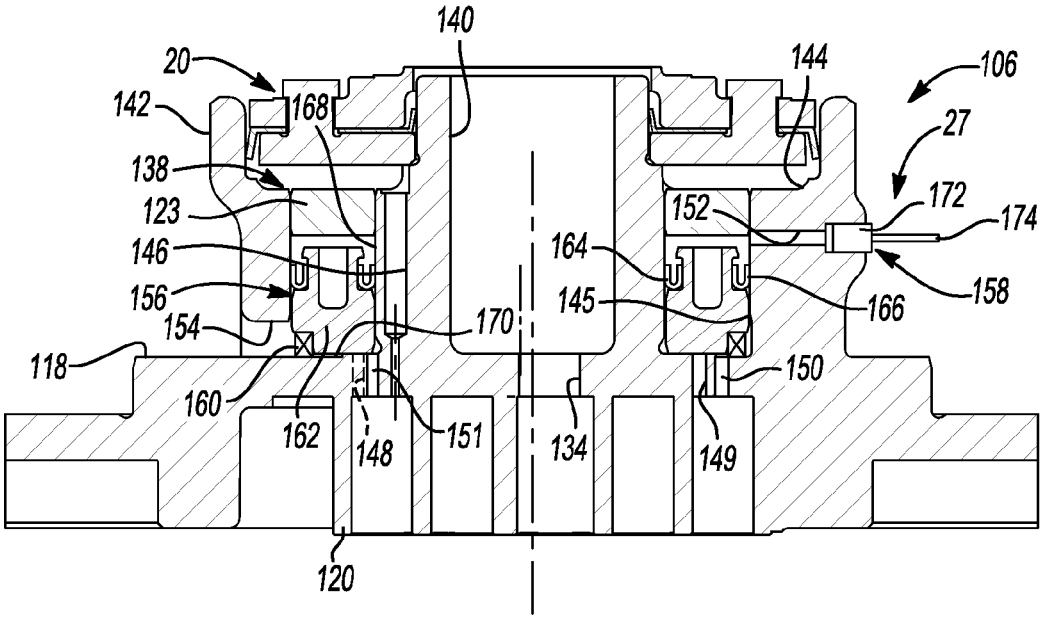
FIG. 3 is a section view of a non-orbiting scroll, seal assembly, and modulation system of the compressor of FIG. 1.
Figure 4:
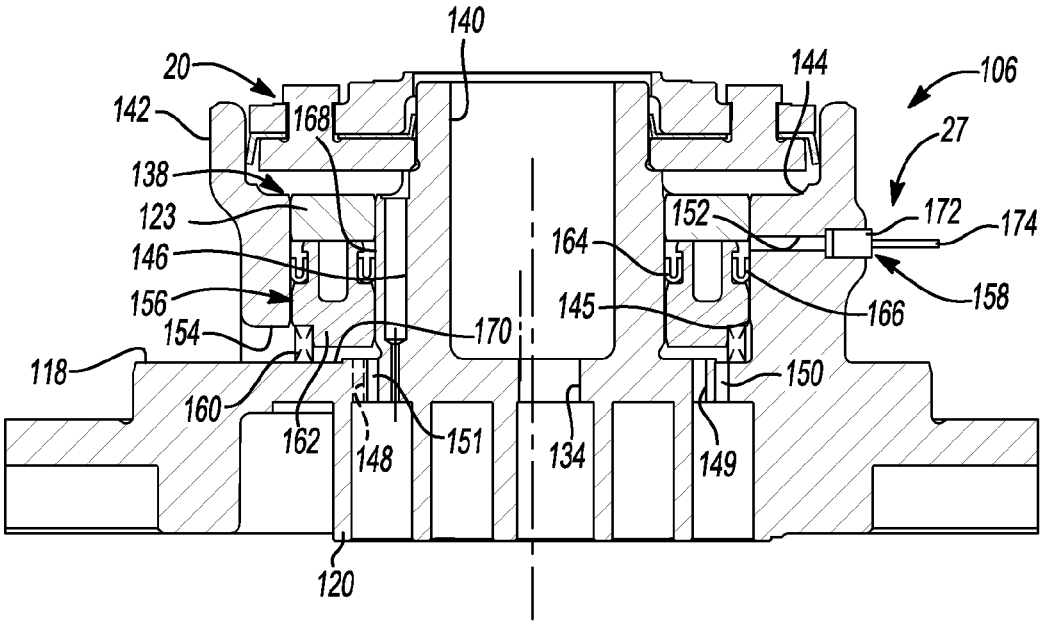
FIG. 4 is an additional section view of the non-orbiting scroll, seal assembly, and modulation system of FIG. 3.

The following description is merely exemplary in nature and is not intended to limit the present disclosure, application, or uses. It should be understood that throughout the drawings, corresponding reference numerals indicate like or corresponding parts and features.

The present teachings are suitable for incorporation in many different types of scroll and rotary compressors, including hermetic machines, open drive machines and non-hermetic machines. For exemplary purposes, a compressor 10 is shown as a hermetic scroll refrigerant-compressor of the low-side type, i.e., where the motor and compressor are cooled by suction gas in the hermetic shell, as illustrated in the vertical section shown in FIG. 1.

With reference to FIG. 1, compressor 10 may include a hermetic shell assembly 12, a main bearing housing assembly 14, a motor assembly 16, a compression mechanism 18, a seal assembly 20, a refrigerant discharge fitting 22, a discharge valve assembly 24, a suction gas inlet fitting 26, and a modulation assembly 27. Shell assembly 12 may house main bearing housing assembly 14, motor assembly 16, and compression mechanism 18.

Shell assembly 12 may generally form a compressor housing and may include a cylindrical shell 28, an end cap 30 at the upper end thereof, a transversely extending partition 32, and a base 34 at a lower end thereof. End cap 30 and partition 32 may generally define a discharge chamber 36. Discharge chamber 36 may generally form a discharge muffler for compressor 10. Refrigerant discharge fitting 22 may be attached to shell assembly 12 at opening 38 in end cap 30. Discharge valve assembly 24 may be located within discharge fitting 22 and may generally prevent a reverse flow condition. Suction gas inlet fitting 26 may be attached to shell assembly 12 at opening 40. Partition 32 may include a discharge passage 46 therethrough providing communication between compression mechanism 18 and discharge chamber 36.

Main bearing housing assembly 14 may be affixed to shell 28 at a plurality of points in any desirable manner, such as staking. Main bearing housing assembly 14 may include a main bearing housing 52, a first bearing 54 disposed therein, bushings 55, and fasteners 57. Main bearing housing 52 may include a central body portion 56 having a series of arms 58 extending radially outwardly therefrom. Central body portion 56 may include first and second portions 60, 62 having an opening 64 extending therethrough. Second portion 62 may house first bearing 54 therein. First portion 60 may define an annular flat thrust bearing surface 66 on an axial end surface thereof. Arm 58 may include apertures 70 extending therethrough and receiving fasteners 57.

Motor assembly 16 may generally include a motor stator 76, a rotor 78, and a drive shaft 80. Windings 82 may pass through stator 76. Motor stator 76 may be press fit into shell 28. Drive shaft 80 may be rotatably driven by rotor 78. Rotor 78 may be press fit on drive shaft 80. Drive shaft 80 may include an eccentric crank pin 84 having a flat 86 thereon.

Compression mechanism 18 may generally include an orbiting scroll 104 and a non-orbiting scroll 106. Orbiting scroll 104 may include an end plate 108 having a spiral vane or wrap 110 on the upper surface thereof and an annular flat thrust surface 112 on the lower surface. Thrust surface 112 may interface with annular flat thrust bearing surface 66 on main bearing housing 52. A cylindrical hub 114 may project downwardly from thrust surface 112 and may have a drive bushing 116 rotatively disposed therein. Drive bushing 116 may include an inner bore in which crank pin 84 is drivingly disposed. Crank pin flat 86 may drivingly engage a flat surface in a portion of the inner bore of drive bushing 116 to provide a radially compliant driving arrangement. An Oldham coupling 11 7 may be engaged with the orbiting and non-orbiting scrolls 104, 106 to prevent relative rotation therebetween.

With additional reference to FIGS. 2-5, non-orbiting scroll 106 may include an end plate 118 having a spiral wrap 120 on a lower surface thereof, a series of radially outwardly extending flanged portions 121, and an annular ring 123. Spiral wrap 120 may form a meshing engagement with wrap 110 of orbiting scroll 104, thereby creating a series of pockets. The pockets created by spiral wraps 110, 120 may change throughout a compression cycle of compression mechanism 18, as discussed below. End plate 118 may include a first and second porting 148, 149 therein, as discussed below. End plate 118 may include first and second porting 148, 149 alone or may additionally include a third and fourth porting 150, 151.

Second porting 149 may be located radially inward relative to first porting 148 and fourth porting 151 may be located radially inward relative to third porting 150. More specifically, fourth porting 151 may be located radially inward relative to a radially inner surface of spiral wrap 120 and at least three hundred and sixty degrees inward along spiral wrap 120 from an outer end 119 of spiral wrap 120. Second porting 149 may be located radially outward relative to a radially outer surface of spiral wrap 120 and at least three hundred and sixty degrees inward along spiral wrap 120 from the location 110-2 where an outer end 110-1 of spiral wrap 110 of orbiting scroll 104 contacts intermittently during a compression cycle, or at least five hundred and forty degrees inward along spiral wrap 120 from outer end 119. Third porting 150 may be located radially inward along spiral wrap 120 relative to a radially inner surface of spiral wrap 120 and less than three hundred and sixty degrees inward from outer end 119 of spiral wrap 120. First porting 148 may be located radially outward relative to a radially outer surface of spiral wrap 120 and less than three hundred and sixty degrees inward from location 110-2, or less than five hundred and forty degrees inward along spiral wrap 120 from outer end 119.

Figure 5:
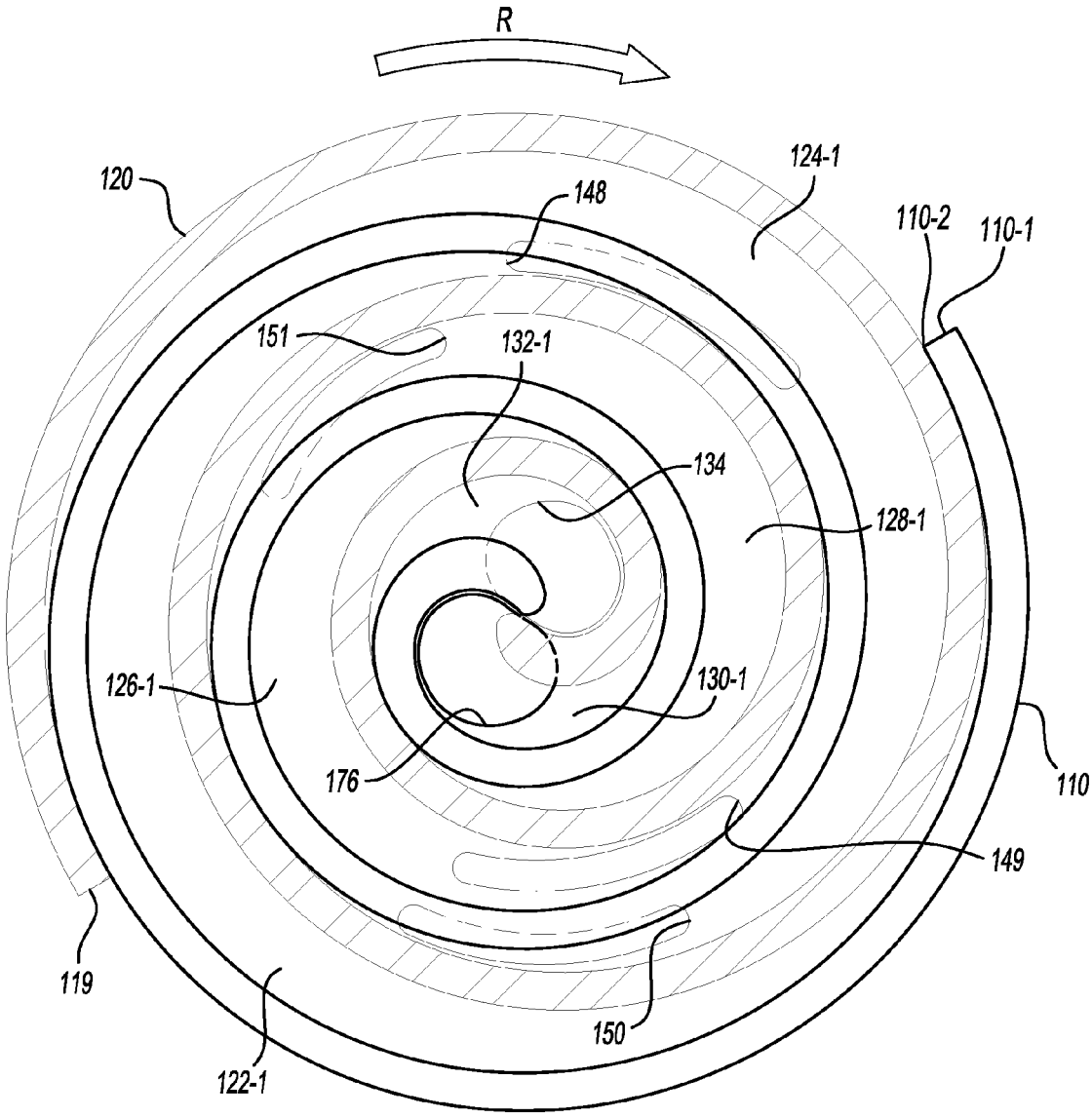
FIG. 5 is a schematic illustration of the orbiting scroll member of FIG. 1 in one orientation.

FIG. 5 illustrates first, second, third, fourth, fifth, and sixth pockets 122-1, 124-1, 126-1, 128-1, 130-1, 132-1 formed by spiral wraps 110, 120. More specifically, FIG. 5 illustrates the start of the compression cycle for first and second pockets 122-1, 124-1. First, second, third and fourth pockets 122-1, 124-1, 126-1, 128-1 may form compression pockets and fifth and sixth pockets 130-1, 132-1 may form discharge pockets in communication with a discharge passage 134 in non-orbiting scroll 106. A recess 176 in orbiting scroll 104 may provide communication between fifth pocket 130-1 and discharge passage 134.

Figure 6:
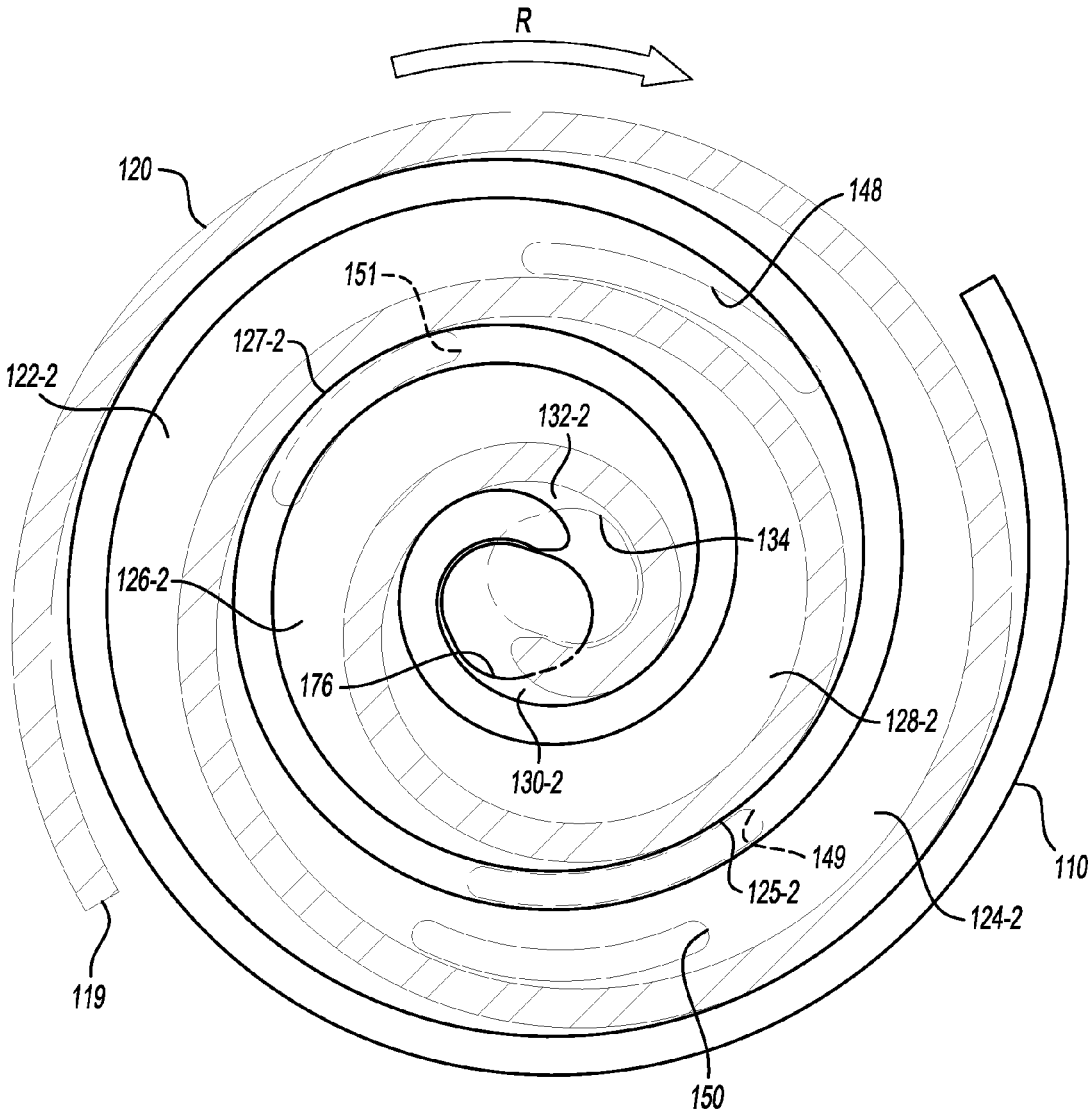
FIG. 6 is a schematic illustration of the orbiting scroll member of FIG. 1 in another orientation.

FIG. 6 illustrates the orbiting scroll 104 in a first position. The first position may generally correspond to approximately eighty degrees of drive shaft rotation relative to FIG. 5. First, second, third, fourth, fifth, and sixth pockets 122-2, 124-2, 126-2, 128-2, 130-2, 132-2 may be formed by the spiral wraps 110, 120 when the orbiting scroll 104 is in the first position. In the first position, first, second, third and fourth pockets 122-2, 124-2, 126-2, 128-2 may form compression pockets and fifth and sixth pockets 130-2, 132-2 may form discharge pockets. Third and fourth pockets 126-2, 128-2 may form first modulated capacity pockets for compression mechanism 18 relative to second porting 149.

The first modulated capacity pockets may generally be defined as the radially outermost compression pockets that are disposed radially inward relative to second porting 149 and isolated from second porting 149 from the time the first modulated capacity pockets are formed until the volume in the first modulated capacity pockets is discharged through discharge passage 134. Thus, the volume in the first modulated capacity pockets may be isolated from second porting 149 during a remainder of a compression cycle associated therewith, as discussed below. The volume of the first modulated capacity pockets may be at a maximum volume when orbiting scroll 104 is in the first position and may be continuously compressed until being discharged through discharge passage 134.

Spiral wrap 110 of orbiting scroll 104 may abut an outer radial surface of spiral wrap 120 at a first location 125-2 and may abut the inner radial surface of spiral wrap 120 at a second location 127-2 generally opposite the first location 125-2 when orbiting scroll 104 is in the first position. Second porting 149 may extend at least twenty degrees along spiral wrap 110 in a rotational direction (R) of drive shaft 80 starting at a first angular position corresponding to the first location 125-2 when orbiting scroll 104 is in the first position. Second porting 149 may be sealed by spiral wrap 110 when orbiting scroll 104 is in the first position. A portion of fourth porting 151 may be in communication with third and fourth pockets 126-2, 128-2 when orbiting scroll 104 is in the first position. First porting 148 may be in communication with first pocket 122-2 and third porting 150 may be in communication with second pocket 124-2 when orbiting scroll 104 is in the first position.

Figure 7:
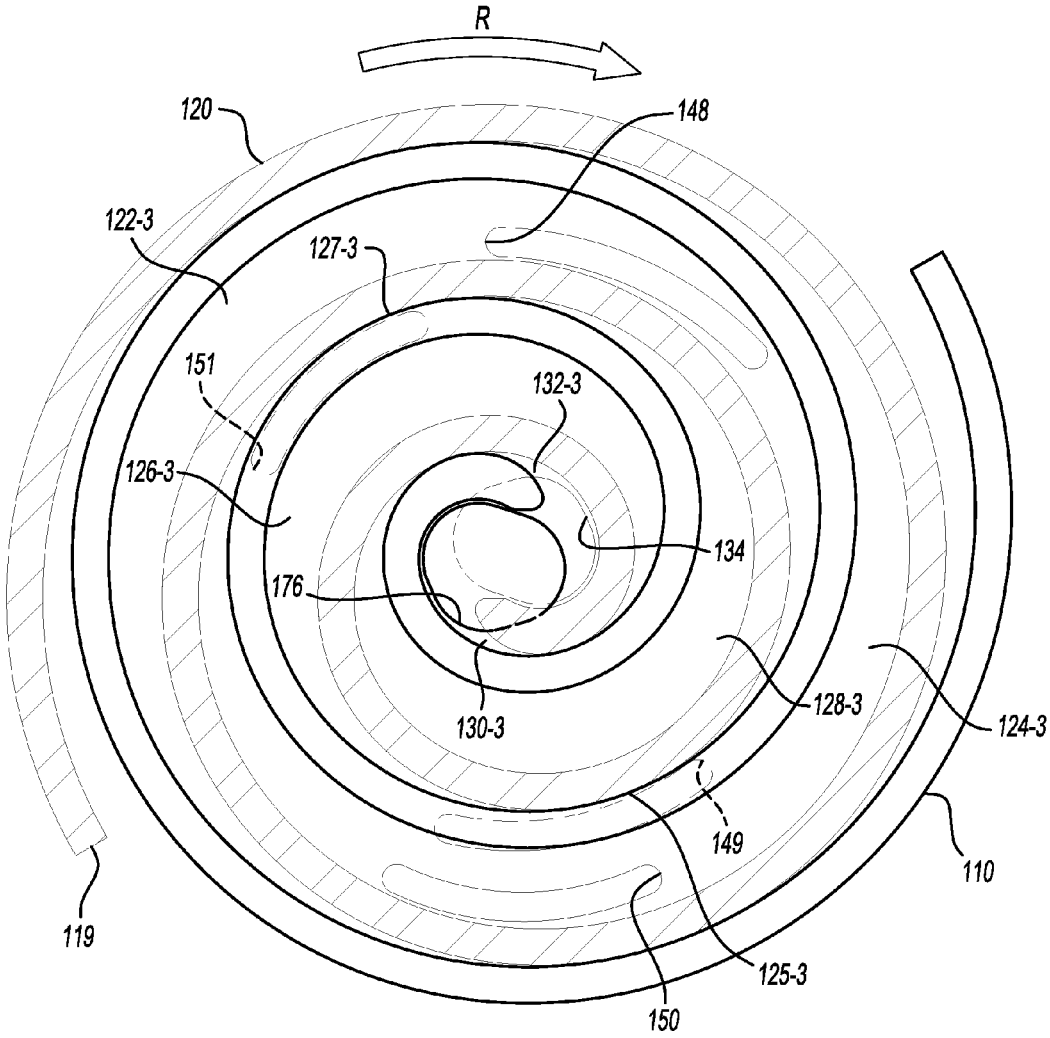
FIG. 7 is a schematic illustration of the orbiting scroll member of FIG. 1 in another orientation.

FIG. 7 illustrates the orbiting scroll 104 in a second position. The second position may generally correspond to approximately one hundred degrees of drive shaft rotation relative to FIG. 5. First, second, third, fourth, fifth, and sixth pockets 122-3, 124-3, 126-3, 128-3, 130-3, 132-3 may be formed by the spiral wraps 110, 120 when the orbiting scroll 104 is in the second position. In the second position, first, second, third and fourth pockets 122-3, 124-3, 126-3, 128-3 may form compression pockets and fifth and sixth pockets 130-3, 132-3 may form discharge pockets in communication with discharge passage 134 in non-orbiting scroll 106. Third and fourth pockets 126-3, 128-3 may form second modulated capacity pockets for compression mechanism 18 relative to second and fourth porting 149, 151.

In the second position, the second modulated capacity pockets may generally be defined as the radially outermost compression pockets that are disposed radially inwardly relative to second and fourth porting 149, 151 and isolated from second and fourth porting 149, 151 from the time the orbiting scroll 104 is in the second position until the volume in the second modulated capacity pockets is discharged through discharge passage 134. The second modulated capacity pockets may correspond to the first modulated capacity pockets after compression resulting from orbiting scroll 104 travelling from the first position to the second position. For example, the compression from the first position to the second position may correspond to approximately twenty degrees of rotation of drive shaft 80.

Spiral wrap 110 of orbiting scroll 104 may abut an outer radial surface of spiral wrap 120 at a third location 125-3 and may abut an inner radial surface of spiral wrap 120 at a fourth location 127-3 generally opposite the third location 125-3 when orbiting scroll 104 is in the second position. Fourth porting 151 may extend at least twenty degrees along spiral wrap 110 generally opposite a rotational direction (R) of drive shaft 80 starting at a second angular position corresponding to the fourth location 127-3 when orbiting scroll 104 is in the second position. Fourth porting 151 may be sealed by spiral wrap 110 when orbiting scroll 104 is in the second position. First porting 148 may be in communication with first pocket 122-3 and third porting 150 may be in communication with second pocket 124-3 when orbiting scroll 104 is in the second position.

Figure 8:
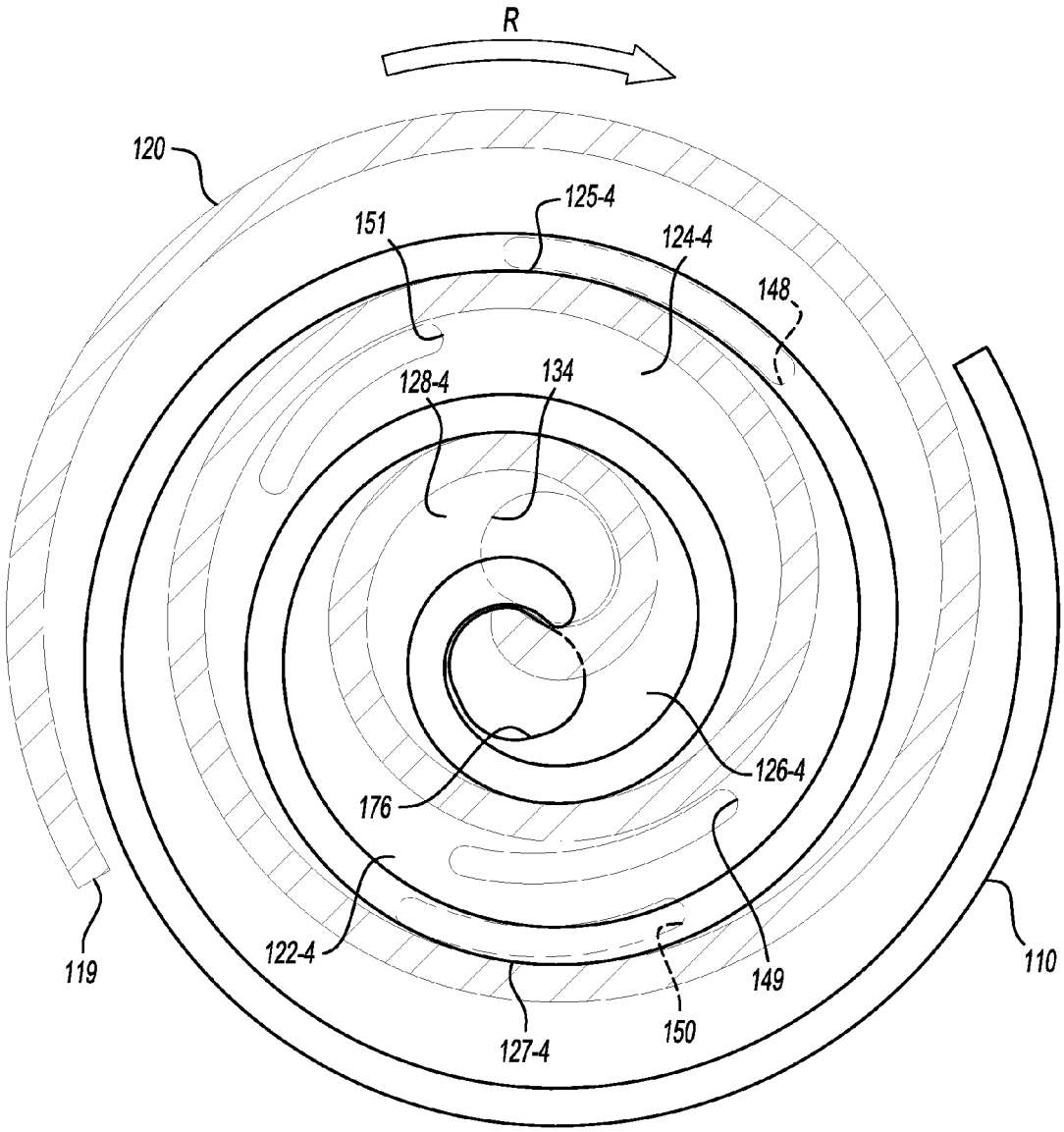
FIG. 8 is a schematic illustration of the orbiting scroll member of FIG. 1 in another orientation.

FIG. 8 illustrates the orbiting scroll 104 in a third position. The third position may generally correspond to approximately three hundred degrees of drive shaft rotation relative to FIG. 5. First, second, third and fourth pockets 122-4, 124-4, 126-4, 128-4 may be formed by the spiral wraps 110, 120 when the orbiting scroll 104 is in the third position. In the third position, first and second pockets 122-4, 124-4 may form compression pockets and third and fourth pockets 126-4, 128-4 may form discharge pockets. Fifth and sixth pockets 130-3, 132-3 shown in FIG. 7 may be discharged through discharge passage 134 as orbiting scroll 104 travels from the second position to the third position.

Spiral wrap 110 of orbiting scroll 104 may abut an outer radial surface of spiral wrap 120 at a fifth location 125-4 and may abut the inner radial surface of spiral wrap 120 at a sixth location 127-4 generally opposite the fifth location 125-4 when orbiting scroll 104 is in the third position. First porting 148 may extend at least twenty degrees along spiral wrap 110 in a rotational direction (R) of drive shaft 80 starting at an angular position corresponding to the fifth location 125-4 when orbiting scroll 104 is in the third position. First porting 148 may be sealed by spiral wrap 110 when orbiting scroll 104 is in the third position. A portion of third porting 150 may be in communication with first and second pockets 122-4, 124-4 when orbiting scroll 104 is in the third position.

Figure 9:
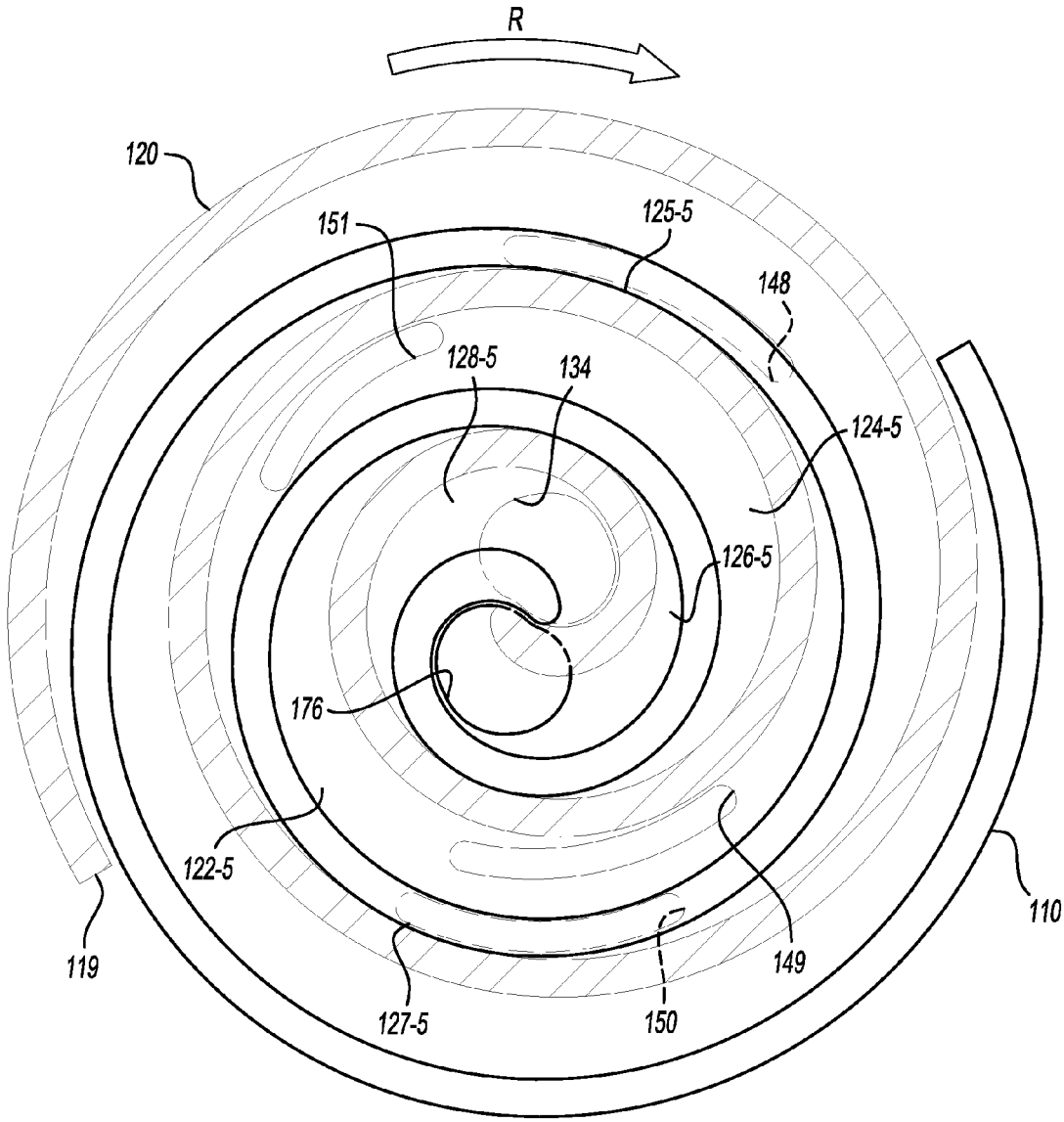
FIG. 9 is a schematic illustration of the orbiting scroll member of FIG. 1 in another orientation.

FIG. 9 illustrates the orbiting scroll 104 in a fourth position. The fourth position may generally correspond to approximately three hundred and twenty degrees of drive shaft rotation relative to FIG. 5. First, second, third and fourth pockets 122-5, 124-5, 126-5, 128-5 may be formed by the spiral wraps 110, 120 when the orbiting scroll 104 is in the fourth position. In the fourth position, first and second pockets 122-5, 124-5 may form compression pockets and third and fourth pockets 126-5,128-5, may form discharge pockets.

Spiral wrap 110 of orbiting scroll 104 may abut an outer radial surface of spiral wrap 120 at a seventh location 125-5 and may abut the an inner radial surface of spiral wrap 120 at a eighth location 127-5 generally opposite the seventh location 125-5 when orbiting scroll 104 is in the fourth position. Third porting 150 may extend at least twenty degrees along spiral wrap 110 generally opposite a rotational direction (R) of drive shaft 80 starting at an angular position corresponding to the eighth location 127-5 when orbiting scroll 104 is in the fourth position. Third porting 150 may be sealed by spiral wrap 110 when orbiting scroll 104 is in the fourth position.

Figure 10:
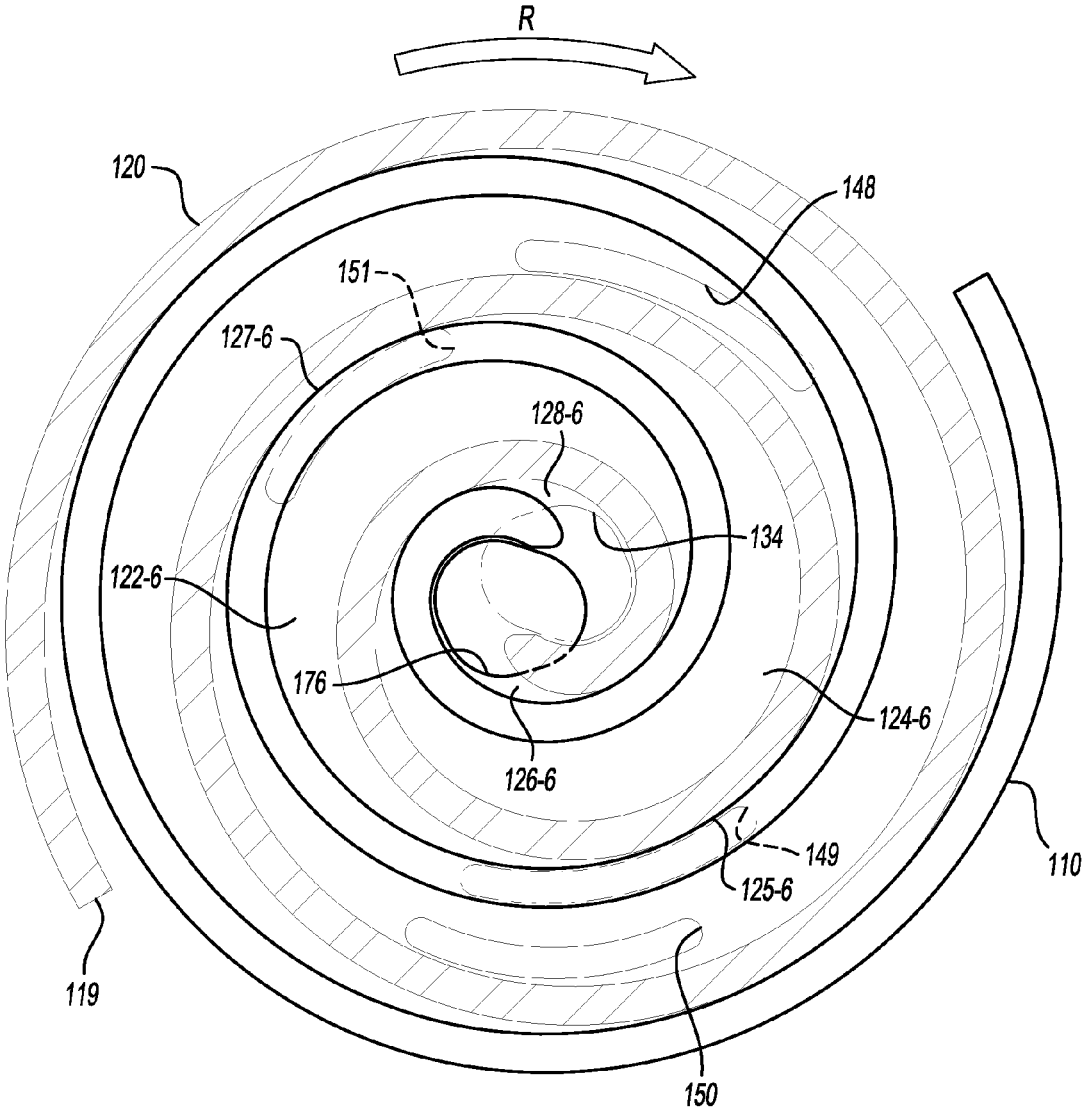
FIG. 10 is a schematic illustration of the orbiting scroll member of FIG. 1 in another orientation.

FIG. 10 generally illustrates the compression of first, second, third and fourth pockets 122-5, 124-5, 126-5, 128-5 (FIG. 9) to first, second, third and fourth pockets 122-6, 124-6, 126-6, 128-6. FIG. 10 generally illustrates the compression resulting from three hundred and sixty degrees of rotation of drive shaft 80 relative to FIG. 6. First and second pockets 122-6, 124-6 may become the first modulated capacity pockets in FIG. 10.

Figure 11:
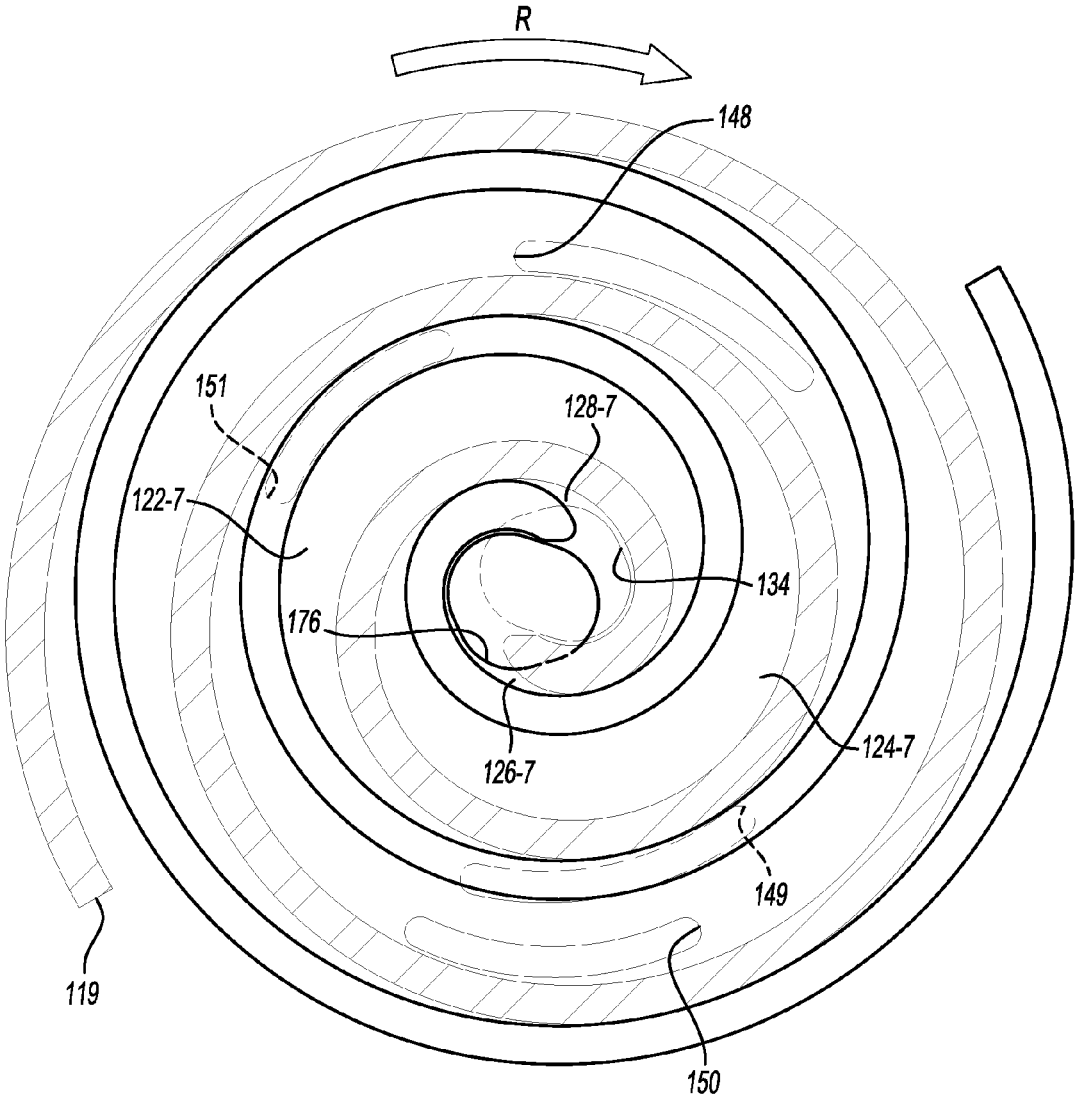
FIG. 11 is a schematic illustration of the orbiting scroll member of FIG. 1 in another orientation.

FIG. 11 generally illustrates the compression of first, second, third and fourth pockets 122-6, 124-6, 126-6, 128-6 (FIG. 10) to first, second, third and fourth pockets 122-7, 124-7, 126-7, 128-7. FIG. 11 generally illustrates the compression resulting from three hundred and sixty degrees of rotation of drive shaft 80 relative to FIG. 7. First and second pockets 122-7, 124-7 may become the second modulated capacity pockets in FIG. 11. First and second pockets 122-7, 124-7 may be discharged through discharge passage 134 upon further rotation of drive shaft 80 to complete the compression cycle for first and second pockets 122-7, 124-7.

Referring back to FIG. 4, non-orbiting scroll 106 may include an annular recess 138 in the upper surface thereof defined by parallel coaxial inner and outer side walls 140, 142. Annular ring 123 may be disposed within annular recess 138 and may separate annular recess 138 into first and second annular recesses 144, 145. First and second annular recesses 144, 145 may be isolated from one another. First annular recess 144 may provide for axial biasing of non-orbiting scroll 106 relative to orbiting scroll 104, as discussed below. More specifically, a passage 146 may extend through end plate 118 of non-orbiting scroll 106, placing first annular recess 144 in fluid communication with one of the pockets formed by the meshing engagement between the spiral wraps 110, 120.

Figure 12:
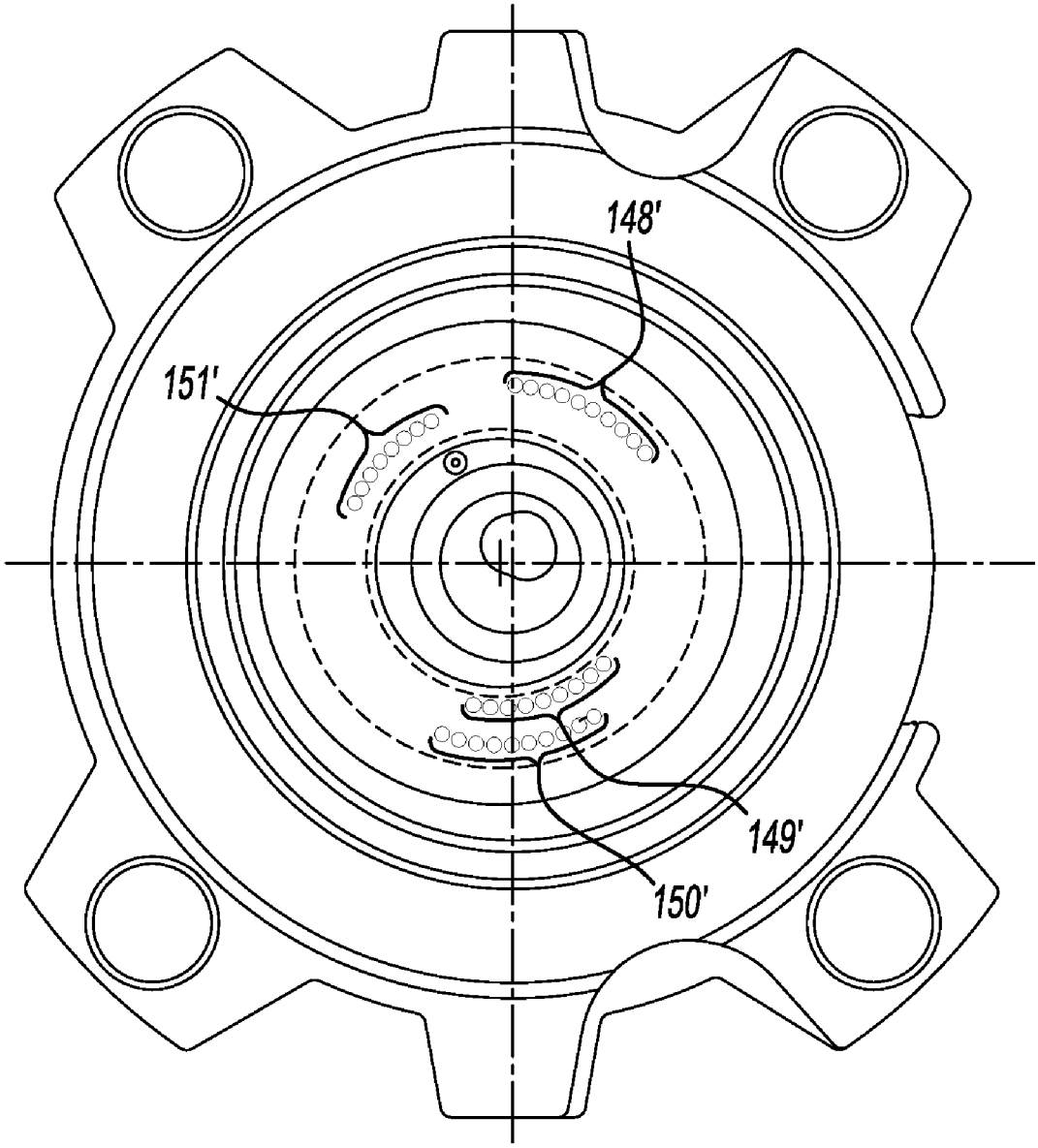
FIG. 12 is a schematic illustration of an alternate compression mechanism according to the present disclosure.

First, second, third and fourth porting 148, 149, 150, 151 are each shown as continuous openings in FIGS. 5-11. However, an alternate first, second, third and fourth porting 148', 149', 150', 151' may each be in the form of a series of discrete openings as seen in FIG. 12.

First, second, third and fourth porting 148, 149, 150, 151 may be placed in second annular recess 145 in communication with four of the pockets formed by the meshing engagement between the spiral wraps 110, 120 during a portion of the compression cycle of compression mechanism 18. Second annular recess 145 may be in communication with different ones of the pockets than first annular recess 144. More specifically, second annular recess 145 may be in communication with pockets located radially outwardly relative to the pocket in communication with the first annular recess 144. Therefore, first annular recess 144 may operate at a pressure greater than an operating pressure of second annular recess 145. First and second radial passages 152, 154 may extend into second annular recess 145 and may cooperate with modulation assembly 27 as discussed below.

Seal assembly 20 may include a floating seal located within first annular recess 144. Seal assembly 20 may be axially displaceable relative to shell assembly 12 and non-orbiting scroll 106 to provide for axial displacement of non-orbiting scroll 106 while maintaining a sealed engagement with partition 32 to isolate discharge and suction pressure regions of compressor 10 from one another. More specifically, pressure within first annular recess 144 may urge seal assembly 20 into engagement with partition 32 during normal compressor operation.

Modulation assembly 27 may include a piston assembly 156, a valve assembly 158, and a biasing member 160. The piston assembly 156 may include an annular piston 162 and first and second annular seals 164, 166. Annular piston 162 may be located in second annular recess 145 and first and second annular seals 164, 166 may be engaged with inner and outer side walls 140, 142 to separate second annular recess 145 into first and second portions 168, 170 that are isolated from one another. First portion 168 may be in communication with first radial passage 152 and second portion 170 may be in communication with second radial passage 154. Valve assembly 158 may include a valve member 172 in communication with a pressure source 174 and with first radial passage 152, and therefore first portion 168. Biasing member may include a spring and may be located in second portion 170 and engaged with annular piston 162.

Annular piston 162 may be displaceable between first and second positions. In the first position (FIG. 3), annular piston 162 may seal first, second, third and fourth porting 148, 149, 150, 151 from communication with second portion 170 of second annular recess 145. In the second position (FIG. 4), annular piston 162 may be displaced from first, second, third and fourth porting 148, 149, 150, 151, providing communication between first, second, third and fourth porting 148, 149, 150,151 and second portion 170 of second annular recess 145. Therefore, when annular piston 162 is in the second position, first, second, third and fourth porting 148, 149, 150, 151 may be in communication with a suction pressure region of compressor 10 via second radial passage 154 providing a reduced capacity operating mode for compressor 10. Additionally, gas may flow from ones of first, second, third, and fourth porting 148, 149, 150, to others of first, second, third, and fourth porting 148, 149, 150, 151 operating at a lower pressure.

As discussed above, second porting 149 may be located radially inward relative to first porting 148 and fourth porting 151 may be located radially inward relative to third porting 150. Therefore, second and fourth porting 149, may generally define the modulated capacity of compressor 10 when annular piston 162 is in the second position as discussed above regarding the first and second modulated capacity pockets. First and third porting 148, 150 may generally form auxiliary porting to prevent compression in pockets located radially outward from second and fourth porting 149, 151 when annular piston 162 is in the second position.

Pressure source 174 may include a pressure that is greater than an operating pressure of the pockets in communication with first, second, third and fourth porting 148, 149, 150, 151. Valve member 172 may provide communication between pressure source 174 and first portion 168 of second annular recess 145 to displace annular piston 162 to the first position. Valve member 172 may prevent communication between pressure source 174 and first portion 168 of second annular recess 145 to displace annular piston 162 to the second position. Valve member 172 may additionally vent first portion 168 to the suction pressure region of compressor 10 to displace annular piston 162 to the second position. Biasing member 160 may generally bias annular piston 162 toward the second position.

While first, second, third and fourth porting 148, 149, 150, 151 have been discussed as providing a two-step capacity modulation arrangement, it is understood that similar porting may alternatively be used to provide a three-step capacity modulation arrangement.

The terms "first", "second", etc. are used throughout the description for clarity only and are not intended to limit similar terms in the claims.

What is claimed is:

1. A compressor comprising:

a housing;

a non-orbiting scroll member supported within said housing and including a first end plate and a first spiral wrap extending from said first end plate;

an orbiting scroll member supported within said housing and including a second end plate having a second spiral wrap extending therefrom and meshingly engaged with said first spiral wrap to form a series of compression pockets;

a first porting extending through said first end plate and located radially outward relative to a radially outer surface of said first spiral wrap at least five hundred and forty degrees inward along said first spiral wrap from an outer end thereof, said first porting being in communication with a first of said compression pockets during a portion of a compression cycle of said orbiting and non-orbiting scroll members, said first and second spiral wraps abutting one another to define first modulated capacity pockets when said orbiting scroll member is in a first position, said first modulated capacity pockets including a set of radially outermost compression pockets located radially inward relative to said first porting and isolated from communication with said first porting during an entirety of said compression cycle, said first porting aligned with said second spiral wrap at a location radially outward from and directly adjacent said first modulated capacity pockets when said orbiting scroll member is in the first position; and additional porting extending through said first end plate and in communication with each of said compression pockets located radially outward relative to said first modulated capacity pockets when said orbiting scroll member is in the first position.

2. The compressor of claim 1, wherein said first porting has an angular extent of at least twenty degrees.

3. The compressor of claim 1, wherein a first angular position defined by said abutting of said first and second spiral wraps defines a starting location of said first porting.

4. The compressor of claim 1, further comprising a second porting extending through said first end plate and located radially inward relative to a radially inner surface of said first spiral wrap at least three hundred and sixty degrees inward along said first spiral from said outer end thereof, said second porting being in communication with a second of said compression pockets during a portion of said compression cycle, said first and second spiral wraps abutting one another to define second modulated capacity pockets when said orbiting scroll member is in a second position subsequent to the first position, said second modulated capacity pockets including a set of radially outermost compression pockets located radially inward relative to said first and second porting and isolated from communication with said first and second porting during an entirety of said compression cycle.

5. The compressor of claim 4, wherein said second porting has an angular extent of at least twenty degrees.

6. The compressor of claim 4, wherein said second porting is aligned with said second spiral wrap at a location radially outward from and directly adjacent said second set of radially outermost pockets when said orbiting scroll member is in the second position.

7. The compressor of claim 4, wherein said second porting is in communication with said first modulated capacity pockets when said orbiting scroll member is in the first position.

8. The compressor of claim 4, wherein said second modulated capacity pockets correspond to said first modulated capacity pockets after displacement of said orbiting scroll member from the first position to the second position.

9. The compressor of claim 4, wherein said additional porting includes a third porting located radially outward relative to said radially outer surface of said first spiral wrap less than five hundred and forty degrees inward along said first spiral from said outer end thereof.

10. The compressor of claim 9, wherein said additional porting includes a fourth porting located radially inward relative to said radially inner surface of said first spiral wrap less than three hundred and sixty degrees inward along said first spiral from said outer end thereof.

11. The compressor of claim 1, wherein a pressure in said first porting is continuously increasing during said compression cycle.

12. The compressor of claim 1, wherein said second spiral wrap overlies an entirety of said first porting when said orbiting scroll member is in the first position.

13. The compressor of claim 1, wherein said first porting is isolated from communication with said compression pockets by said second spiral wrap when said orbiting scroll member is in the first position.

14. The compressor of claim 1, wherein said first porting includes a continuous aperture.

15. The compressor of claim 1, wherein said porting includes a series of discrete apertures.

16. The compressor of claim 1, further comprising a valve member in communication with said first porting and said additional porting to selectively provide communication between said compression pockets located radially outward from said first modulated capacity pockets and a bypass location external to said compression pockets.

17. The compressor of claim 16, wherein said bypass location includes a suction pressure region of the compressor.

* * * * *

UNITED STATES PATENT AND TRADEMARK OFFICE

CERTIFICATE OF CORRECTION

PATENT NO. : 7,967,583 B2
APPLICATION NO. : 12/474954
DATED : June 28, 2011
INVENTOR(S) : Robert C. Stover et al.

It is certified that error appears in the above-identified patent and that said Letters Patent is hereby corrected as shown below:

| | |
|---|---|
| Column 2, Line 38 | "increasing" should be --increases--. |
| Column 2, Line 39 | "overlies" should be --overlying--. |
| Column 4, Line 29 | "11 7" should be --117--. |
| Column 6, Line 66 | After "the", delete "an". |
| Column 6, Line 67 | "a eighth" should be --an eighth--. |
| Column 8, Line 17 | After "biasing member", insert --160--. |
| Column 8, Line 35 | "148, 149, 150," should be --148, 149, 150, 151--. |
| Column 8, Line 41 | After "149," insert --151--. |

Signed and Sealed this
Thirteenth Day of September, 2011

David J. Kappos

David J. Kappos
*Director of the United States Patent and Trademark Office*